US010080400B2

(12) United States Patent
Corrion

(10) Patent No.: US 10,080,400 B2
(45) Date of Patent: Sep. 25, 2018

(54) SPILL RESISTANT SEAT BELT BUCKLE ASSEMBLY

(71) Applicant: GM Global Technology Operations LLC, Detroit, MI (US)

(72) Inventor: Steven G. Corrion, Oxford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 397 days.

(21) Appl. No.: 14/683,335

(22) Filed: Apr. 10, 2015

(65) Prior Publication Data

US 2015/0307062 A1 Oct. 29, 2015

Related U.S. Application Data

(60) Provisional application No. 61/984,584, filed on Apr. 25, 2014.

(51) Int. Cl.
*A44B 11/25* (2006.01)

(52) U.S. Cl.
CPC ..... *A44B 11/2546* (2013.01)

(58) Field of Classification Search
CPC ..... A44B 11/2546
See application file for complete search history.

(56) References Cited

FOREIGN PATENT DOCUMENTS

| | | | |
|---|---|---|---|
| CN | 101270260 | A | 9/2008 |
| WO | 2012035860 | A1 | 3/2012 |

OTHER PUBLICATIONS

Chinese Office Action dated Mar. 29, 2017; Application No. 201510199237.1; Applicant: GM Global Operations Technology LLC.; 9 pages.

*Primary Examiner* — Abigail E Troy
(74) *Attorney, Agent, or Firm* — BrooksGroup

(57) ABSTRACT

A number of variation may include a seat belt buckle assembly having a first shell and a second mating shell, the first shell having a first inner face and second shell having a second inner face, a seat belt latching assembly received inside of the first shell and second shell a hydrophobic coating over at least one of the first inner face, second inner face, or the seat belt latching assembly.

20 Claims, 1 Drawing Sheet

SPILL RESISTANT SEAT BELT BUCKLE ASSEMBLY

CROSS-REFERENCE TO RELATED APPLICATIONS

This application claims the benefit of U.S. Provisional Application No. 61/984,584 filed Apr. 25, 2014.

TECHNICAL FIELD

The field to which the disclosure generally relates to includes vehicle seat belt assemblies.

BACKGROUND

Vehicles may include seat belt assemblies with releasable lock mechanisms.

SUMMARY OF SELECT ILLUSTRATIVE VARIATIONS

A number of variations may include a seat belt buckle assembly having a first shell and a second mating shell, the first shell having a first inner face and second shell having a second inner face, a seat belt latching assembly may be received inside of the first shell and second shell a hydrophobic coating over at least one of the first inner face, second inner face, or the seat belt latching assembly.

A number of other variations may include a seat belt buckle assembly which may include a first shell and a second mating shell. The first shell may have a first inner face and the second shell may include a second inner face. Additionally, the seat belt buckle assembly may include a seat belt latching assembly which may be received inside of the first shell and the second shell. Moreover, a hydrophobic coating may be disposed over the first inner face, the second inner face and the seat belt latching assembly.

Yet a number of other variations may include an assembly which may have a first shell and a second mating shell. The first shell may have a first inner face and the second shell may include a second inner face. The first shell and the second shell may be mated to form a cavity. Additionally, the assembly may include a seat belt latching assembly which may be received inside of the cavity. Moreover, a hydrophobic coating may be disposed over at least one of the first inner face, the second inner face or the seat belt latching assembly.

Other illustrative variations within the scope of the invention will become apparent from the detailed description provided hereinafter. It should be understood that the detailed description and specific examples, while disclosing variations within the scope of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

The following description of the variations is merely illustrative in nature and is in no way intended to limit the scope of the invention, its application, or uses.

The following description of variants is only illustrative of components, elements, acts, product and methods considered to be within the scope of the invention and are not in any way intended to limit such scope by what is specifically disclosed or not expressly set forth. The components, elements, acts, product and methods as described herein may be combined and rearranged other than as expressly described herein and still are considered to be within the scope of the invention.

Seat belt buckles are vulnerable to contamination of various types due to their open design, and position relative to occupants and cup holders. Buckle mechanisms have several moving parts with minimal clearances to guide these parts. Liquid spills such as soft drinks, coffee, and other beverages which, when dried, leave a sticky residue that can interfere with the proper function of the buckle mechanism.

Figure 1:
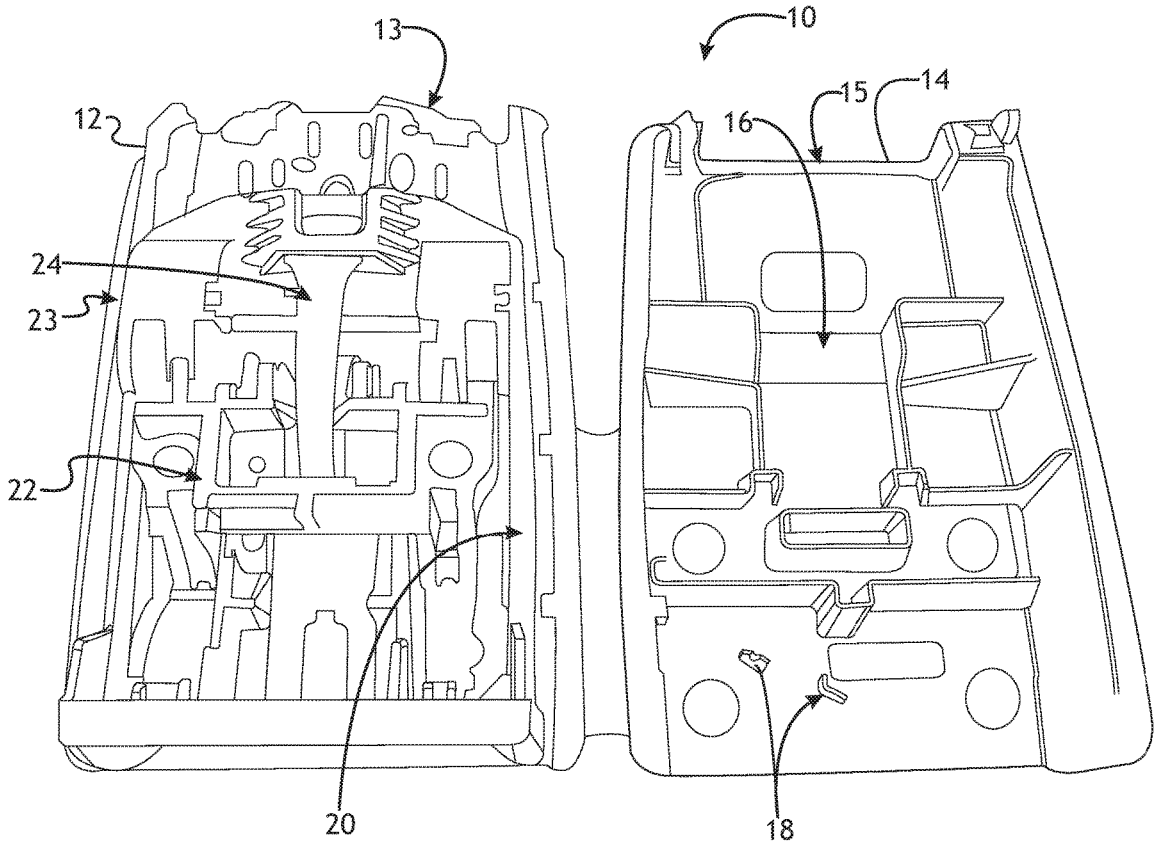
FIG. 1 illustrates seat belt buckle assembly having a first shell portion and a second shell portion in an open position exposing a seat belt buckle or latch mechanism.

FIG. 1 illustrates seat belt buckle assembly 10 having a first shell portion 12 and a second shell portion 14 in an open position exposing a seat belt buckle or latch mechanism 23 and identifying a plurality of locations 16, 18, 20, 22, 24, where liquid contamination may accumulate and cause undesirable performance of the belt buckle or latch mechanism 23.

A number of variations may include the seat belt buckle assembly 10 having the first shell portion 12 and the second mating shell portion 14, the first shell having a first inner face 13 and second shell having a second inner face 15, the seat belt latching assembly 23 may be received inside of the first shell 12 and second shell 14, and a hydrophobic coating over at least a portion of one of the first inner face 13, second inner face 15, or the seat belt latching assembly 23.

Referring again to FIG. 1, it is contemplated that the first shell portion 12 may be generally a rectangular shell which may include a plurality of walls which may form a portion of walls of of a cavity. Additionally, the first shell 12 may include the latch mechanism 23. The latch mechanism 23 may be constructed and arranged to receive a seat belt buckle. Additionally, it is contemplated that the latch mechanism 23 may be constructed and arranged to securely hold the seat belt in place as known by one of ordinary skill in the art. It is contemplated that the latch mechanism 23 may be operably coupled to one or more of the first 12 or second 14 shells. The latch mechanism 23 may include various apertures or other features in order to securely hold the seat belt buckle and/or to have the latch mechanism 23 be secured to the first 12 and/or second 14 shell.

Referring again to the figure illustrated in FIG. 1, it is contemplated when the first shell portion 12 and the second shell portion 14 are mated that the latch mechanism 23 may come into contact with the second inner face 15 of the second shell portion 14. Additionally it is contemplated that the latch mechanism 23 may not touch the second inner face 15 of the second shell portion 14 and a gap may remain between the latch mechanism and the second inner face 15.

Moreover, as illustrated in FIG. 1 the first inner shell 12 and the latch mechanism 23 may include various contours and elevations. The contours and elevations may differ between specific variations of the seat belt buckle. However the contours and elevations may provide a plurality of locations 16, 18, 20, 22 and 24 where liquid contamination may accumulate and may cause undesirable performance of the belt buckle or latch mechanism.

Referring again to the variation illustrated in FIG. 1, it is contemplated that the second shell portion 14 along with the second inner face 15 may include various contours and elevations. It is contemplated that the contours and elevations may match either the latch mechanism or the contours and elevations of the first inner face 13 of the first shell portion 12 in order to mate thereto. Additionally, the different elevations and contours of the second inner face 15 may provide a plurality of locations where liquid contamination may accumulate and cause undesirable performance of the belt buckle or latch mechanism.

Referring again to the variation illustrated in FIG. 1 in a number of variations, the first shell portion 12 and the second shell 14 portion may be formed as a single integral piece. The single integral piece may include the latch mechanism 23 disposed in a cavity thereof. Additionally or alternatively, the first shell portion 12 and the second shell portion 14 may be various pieces which may be mated together in order to form the seat belt buckle assembly 10.

Figure 2:
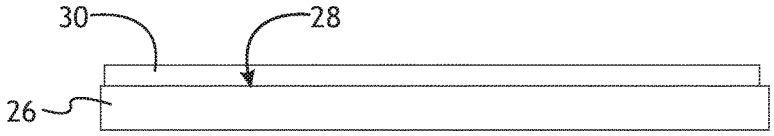
FIG. 2 illustrates a seat belt buckle component having a hydrophobic coating thereon according to a number of variations.

FIG. 2 illustrates a number of variations, which may include a vehicle seat belt component 26 having a surface 28 and a hydrophobic coating 30 over or on the surface 28. It is contemplated that the hydrophobic coating 30 may be disposed on any or all of the first shell 12, the second shell 14, the first inner face 13, the second inner face 15, or the seat belt latching mechanism 23. Moreover, it is contemplated that the hydrophobic coating 30 may be disposed only on a portion of the first shell 12, second shell 14, first inner face 13, second inner face 15 or seat belt latching assembly 23. Specifically, as illustrated in FIGS. 1 and 2, the hydrophobic coating 30 may be disposed in a plurality of locations including but not limited to locations 16, 18, 20, 22, or 24 where liquid contamination may accumulate. Based on specific designs of the first 12 and second 14 shells, it is contemplated that the plurality of locations may be the same or different based on different variations of the seat belt assembly. It is contemplated that one of ordinary skill in the art may provide targeted coating to specific locations.

The coating 30 may be an anti-wetting coating. In a number of variations the coating 30 may be of any of varieties of hydrophobic coatings. In a number of variations the hydrophobic coating 30 may be a superhydrophobic coating such as, but not limited to, the coating available under the tradename NeverWet available from Ross Nanotechnology. In a number of variations the coating 30 may be super-hydrophobic coating that may be a nanoscopic surface layer that repels water. Application of the super hydrophobic coatings can be applied to existing buckle designs, with little or no modification. This results in little or no redesign of the base mechanism, yet makes the components resistant to contamination from liquid spills.

In a number of variations the coating 30 may be a nanotechnology coating, which may be super hydrophobic can completely repel water and other liquids. Any liquid placed on this coating is repelled and simply rolls off without touching the underlying surface. Application of such nanotechnology coatings in seat belt buckles would prevent collection of liquid spills which when dried interfere with the proper function of the buckle mechanism.

Variation 1 may include the seat belt buckle assembly which may include a first shell and second mating shell, the first shell having a first inner face and the second shell having a second inner face, and a seat belt latching assembly which may be received inside of the first shell and the second shell and a hydrophobic coating over at least one of the first inner face, second inner face or seat belt latching assembly.

Variation 2 may include the seat belt buckle assembly according to variation 1 wherein the hydrophobic coating may cover each of the first inner face, the second inner face and the seat belt latching assembly.

Variation 3 may include the seat belt buckle assembly as set forth in any of variations 1 to 2 wherein the hydrophobic coating may be resistant to liquid contamination.

Variation 4 may include the seat belt buckle assembly as set forth in any of variations 1 to 3 wherein the first shell and the second shell may be a single integral piece.

Variation 5 may include the seat belt buckle assembly as set forth in any of variations 1 to 4 wherein the hydrophobic coating may be a superhydrophobic coating.

Variation 6 may include the seat belt buckle assembly as set forth in any of variations 1 to 5 wherein the seat belt buckle assembly may be resistant to liquid contamination.

Variation 7 may include the seat belt buckle assembly as set forth in any of variations 1 to 6 wherein the seat belt buckle assembly may be constructed and arranged to prevent residue from collecting in the first shell or the second shell.

Variation 8 may include a seat belt buckle assembly which may include a first shell and a second mating shell the first shell having a first inner face and the second shell having a second inner face, a seat belt latching assembly which may be received inside of the first shell and the second shell, and a hydrophobic coating over the first inner face, second inner face and the seat belt latching assembly.

Variation 9 may include the seat belt buckle assembly as set forth in variation 8 wherein the hydrophobic coating may be resistant to liquid contamination.

Variation 10 may include the seat belt buckle assembly as set forth in any of variations 8 to 9 wherein the first shell and the second shell may be a single integral piece.

Variation 11 may include the seat belt buckle assembly as set forth in any of variations 8 to 10 wherein the hydrophobic coating may be a superhydrophobic coating.

Variation 12 may include the seat belt buckle assembly as set forth in any of variations 8 to 11 wherein the seat belt buckle assembly may be resistant to liquid contamination.

Variation 13 may include the seat belt buckle assembly as set forth in any of variations 8 to 12 wherein the seat belt buckle assembly may be constructed and arranged to prevent residue from collecting in the first shell or the second shell.

Variation 14 may include an assembly which may include a first shell and a second mating shell, the first shell having a first inner face and the second shell may have a second inner face, the first shell and the second shell may be mated to form a cavity, a seat belt latching assembly may be received inside the cavity, and a hydrophobic coating may be disposed over at least one of the first inner face, the second inner face or the seat belt latching assembly.

Variation 15 may include the assembly as set forth in variation 14 wherein the hydrophobic coating may cover each of the first inner face, the second inner face and the seat belt latching assembly.

Variation 16 may include the assembly as set forth in any of variations 14 to 15 wherein the hydrophobic coating may be resistant to liquid contamination.

Variation 17 may include the assembly as set forth in any of variations 14 to 16 wherein the first shell and the second shell may be a single integral piece.

Variation 18 may include the assembly as set forth in any of variations 14 to 17 wherein the hydrophobic coating may be superhydrophobic coating.

Variation 19 may include the assembly as set forth in any of variations 14 to 18 wherein the seat belt buckle assembly may be resistant to liquid contamination.

Variation 20 may include the assembly as set forth in any of variations 14 to 19 wherein the assembly may be constructed and arranged to prevent residue from collecting on the first shell or the second shell.

The above description of select variations within the scope of the invention is merely illustrative in nature and, thus, variations or variants thereof are not to be regarded as a departure from the spirit and scope of the invention.

What is claimed is:

1. A seat belt buckle assembly comprising:

a first shell and a second shell, the first shell having a first inner face and the second shell having a second inner face;

a seat belt latching assembly received inside of the first shell and the second shell; and a hydrophobic coating over at least one of the first inner face, the second inner face, or the seat belt latching assembly.

2. The seat belt buckle assembly of claim 1 wherein the hydrophobic coating covers each of the first inner face, the second inner face, and the seat belt latching assembly.

3. The seat belt buckle assembly of claim 1, wherein the hydrophobic coating is resistant to liquid contamination.

4. The seat belt buckle assembly of claim 1, wherein the first shell and the second shell are a single integral piece.

5. The seat belt buckle assembly of claim 1, wherein the hydrophobic coating is a super hydrophobic coating.

6. The seat belt buckle assembly of claim 1, wherein the seat belt buckle assembly is resistant to liquid contamination.

7. The seat belt buckle assembly of claim 1, wherein the seat belt buckle assembly is constructed and arranged to prevent residue from collecting in the first shell or the second shell.

8. A seat belt buckle assembly comprising:

a first shell and a second shell, the first shell having a first inner face and the second shell having a second inner face;

a seat belt latching assembly received inside of the first shell and the second shell; and a hydrophobic coating over the first inner face, the second inner face, and the seat belt latching assembly.

9. The seat belt buckle assembly of claim 8, wherein the hydrophobic coating is resistant to liquid contamination.

10. The seat belt buckle assembly of claim 8, wherein the first shell and the second shell are a single integral piece.

11. The seat belt buckle assembly of claim 8, wherein the hydrophobic coating is a super hydrophobic coating.

12. The seat belt buckle assembly of claim 8, wherein the seat belt buckle assembly is resistant to liquid contamination.

13. The seat belt buckle assembly of claim 8, wherein the seat belt buckle assembly is constructed and arranged to prevent residue from collecting in the first shell or the second shell.

14. An assembly comprising:

a first shell and a second shell, the first shell having a first inner face and the second shell having a second inner face, wherein the first shell and the second shell are mated to form a cavity;

a seat belt latching assembly received inside of the cavity; and a hydrophobic coating over at least one of the first inner face, the second inner face, or the seat belt latching assembly.

15. The assembly of claim 14 wherein the hydrophobic coating covers each of the first inner face, the second inner face, and the seat belt latching assembly.

16. The assembly of claim 14, wherein the hydrophobic coating is resistant to liquid contamination.

17. The assembly of claim 14, wherein the first shell and the second shell are a single integral piece.

18. The assembly of claim 14, wherein the hydrophobic coating is a super hydrophobic coating.

19. The assembly of claim 14, wherein the assembly is resistant to liquid contamination.

20. The assembly of claim 14, wherein the assembly is constructed and arranged to prevent residue from collecting in the first shell or the second shell.

* * * * *